US005727537A

United States Patent [19]

Nakagawa et al.

[11] Patent Number: 5,727,537

[45] Date of Patent: Mar. 17, 1998

[54] FUEL SUPPLY CONTROL SYSTEM FOR AN ENGINE

[75] Inventors: Norihisa Nakagawa, Numazu; Hiroki Matsuoka, Susono; Michihiro Ohashi, Misima, all of Japan

[73] Assignee: Toyota Jidosha Kabushiki Kaisha, Aichi, Japan

[21] Appl. No.: 548,115

[22] Filed: Oct. 25, 1995

[30] Foreign Application Priority Data

Oct. 25, 1994 [JP] Japan ..... 6-260314

[51] Int. Cl.[6] ..... F02D 41/00; F02M 23/00; F02M 25/00

[52] U.S. Cl. ..... 123/698

[58] Field of Search ..... 123/698, 690, 123/429, 520, 674, 680

[56] References Cited

U.S. PATENT DOCUMENTS

| | | | |
|---|---|---|---|
| 5,570,674 | 11/1996 | Izumiura et al. | 123/690 |
| 5,579,747 | 12/1996 | Sato et al. | 123/690 |
| 5,611,319 | 3/1997 | Machida | 123/680 |
| 5,613,481 | 3/1997 | Kitagawa et al. | 123/698 |
| 5,623,914 | 4/1997 | Kawamoto et al. | 123/689 |

FOREIGN PATENT DOCUMENTS

| | | |
|---|---|---|
| 5-26118 | 2/1993 | Japan . |
| 5-248312 | 9/1993 | Japan . |

*Primary Examiner*—Raymond A. Nelli
*Attorney, Agent, or Firm*—Kenyon & Kenyon

[57] ABSTRACT

A fuel supply control system for an engine comprises a fuel injector for feeding fuel into the engine, a canister for temporarily storing fuel vapor, and an air-fuel ratio sensor for sensing an air-fuel ratio of the engine. The canister is connected to an intake passage downstream of a throttle valve to purge a purge gas, that is, air containing fuel vapor, into the intake passage. An amount of fuel to be injected from the fuel injector is corrected in accordance with output a signals of the air-fuel ratio sensor to make the air-fuel ratio equal to a target air-fuel ratio. An initial value of a fuel vapor concentration coefficient, which represents a concentration of fuel vapor in air fed into the engine, is calculated in accordance with a deviation caused when the purging operation starts. A decrement of the fuel vapor concentration coefficient caused when the purge gas is purged by a predetermined amount is calculated using a relationship between the decrement and the fuel vapor concentration coefficient, which relationship is prepared in advance. The fuel vapor concentration coefficient is further corrected by subtracting the decrement from the initial value whenever the purge gas is purged by the predetermined amount. The amount of fuel is reduced in accordance with the fuel vapor concentration coefficient.

16 Claims, 11 Drawing Sheets

FUEL SUPPLY CONTROL SYSTEM FOR AN ENGINE

BACKGROUND OF THE INVENTION

1. Field of the Invention

The present invention relates to a fuel supply control system for an engine.

2. Description of the Related Art

Japanese Unexamined Patent Publication No. 5-248312 discloses a fuel supply control system for an engine. The system includes a canister for temporarily storing fuel vapor. The canister is connected to an intake passage of the engine, downstream of a throttle valve arranged therein, to purge a purge gas, namely, air containing fuel vapor, into the engine. The system further include an air-fuel ratio sensor arranged in an exhaust passage of the engine, which sensor outputs a signal representing an air-fuel ratio. An amount of fuel to be injected by a fuel injector is corrected by a feedback correction coefficient, in accordance with the output signals from the air-fuel ratio sensor, to make the air-fuel ratio equal to a target air-fuel ratio.

In this system, the amount of fuel vapor initially stored in the canister is estimated based on the deviation in the feedback correction coefficient which occurs when the purging operation starts. Based on the initially stored amount of fuel vapor, an initial concentration of fuel vapor in the purge gas is estimated. The amount of fuel vapor purged from the canister during a predetermined period is estimated in accordance with a fuel vapor concentration coefficient corresponding to a concentration of the fuel vapor in the purge gas and with the amount of the purge gas purged during the predetermined period. An amount of fuel vapor stored in the canister is fuel vapor from the canister from the initial stored amount, whenever the purging operation is carried out for the predetermined period. In advance, the relationship between the amount of fuel vapor stored in the canister and the concentration of fuel vapor in the purge gas is obtained by experiment. The fuel vapor concentration in the purge gas is periodically calculated in accordance with the stored amount of fuel vapor using this relationship. In accordance with the fuel vapor concentration in the purge gas, the amount of fuel to be injected from the fuel injector is reduced to make the air-fuel ratio equal to the target air-fuel ratio.

In a typical fuel vapor emission system, fuel vapor generated in, for example, a fuel tank of the engine is continuously introduced into the canister, even during the purging operation. In this condition, a part of fuel vapor introduced into the canister is purged into the intake passage after it is temporarily stored in the canister, and the reminder is purged into the intake passage without being temporarily stored in the canister. However, when the amount of fuel vapor generated in the fuel tank increases due to, for example, a temperature rise in the fuel tank, if an storing ability of the canister is lowered, namely, if the canister is substantially saturated, almost all of fuel vapor introduced into the canister is purged into the intake passage without being temporarily stored in the canister. As a result, in the above-mentioned system, the relationship between the amount of fuel vapor stored in the canister and the concentration of fuel vapor in the purge gas deviates from the relationship obtained in advance. Therefore, it becomes impossible to correctly calculate the concentration of fuel vapor, and thereby it becomes impossible to properly reduce the amount of fuel to be injected. Therefore, a problem occurs that it is no longer possible to keep the air-fuel ratio at the target air-fuel ratio, in the above-mentioned system.

SUMMARY OF THE INVENTION

An object of the present invention is to provide a fuel supply control system which is able to keep an air-fuel ratio at a target air-fuel ratio.

According to the present invention, there is provided a fuel supply control system for an engine having an intake passage, a throttle valve arranged in the intake passage, and an exhaust passage, the system comprising: a fuel injector for feeding fuel into the engine; fuel amount calculating means for calculating an amount of fuel to be injected by the fuel injector; an air-fuel ratio sensor arranged in the exhaust passage for sensing an air-fuel ratio of the engine; a first correcting means for correcting the amount of fuel by a feedback correction coefficient in accordance with output signals of the air-fuel ratio sensor to make the air-fuel ratio equal to a target air-fuel ratio, the feedback correction coefficient having a reference value; a canister for temporarily storing fuel vapor therein, the canister being connected to the intake passage downstream of the throttle valve via a purge passage; purge means for purging a purge gas containing fuel vapor from the canister, via the purge passage, into the intake passage; initial value calculating means for calculating an initial value of a fuel vapor concentration coefficient, which represents a concentration of fuel vapor in air fed into the engine, in accordance with a deviation of the feedback correction coefficient from the reference value, which deviation is caused when the purging operation starts; decrement calculating means for calculating a decrement of the fuel vapor concentration coefficient caused when the purging operation is carried out, the decrement being determined in accordance with the fuel vapor concentration coefficient; first concentration coefficient calculating means for calculating the fuel vapor concentration coefficient by periodically reducing the fuel vapor concentration coefficient, from the initial value calculated by initial value calculating means, by the decrement calculated by the decrement calculating means; second correcting means for reducing the amount of fuel in accordance with the fuel vapor concentration coefficient, when the purge gas is purged into the intake passage; and control means for controlling second correcting means to carry out the correcting operation of second correcting means when the feedback correction coefficient is within a predetermined range, and to stop the correcting operation of second correcting means when the feedback correction coefficient is out of the predetermined range.

The present invention may be more fully understood from the description of preferred embodiments of the invention set forth below, together with the accompanying drawings.

DESCRIPTION OF THE PREFERRED EMBODIMENTS

Figure 1:
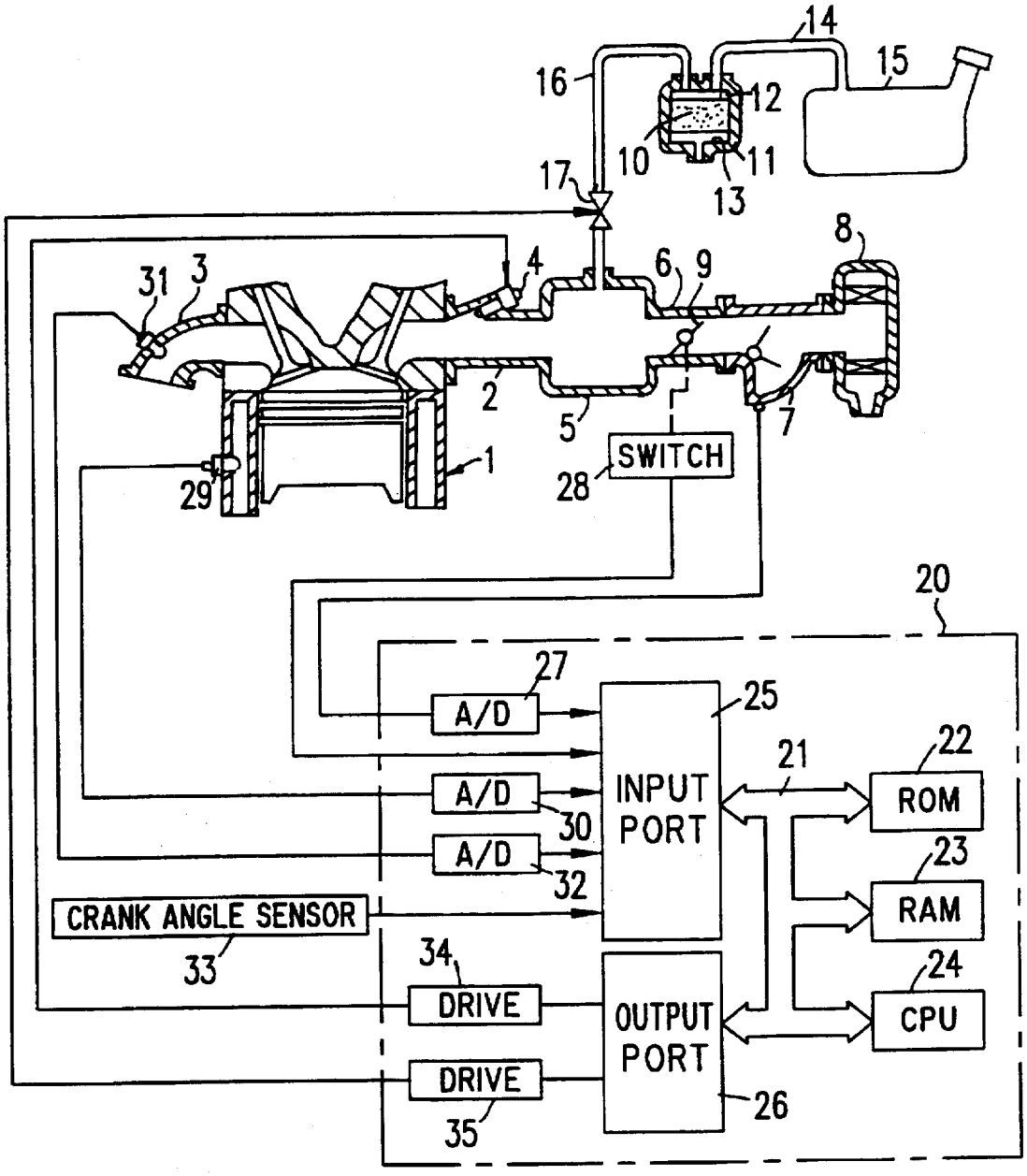
FIG. 1 is a general view of an engine.

Referring to FIG. 1, a reference numeral 1 designates an engine body, 2 designates an intake branch, 3 designates an exhaust manifold, and 4 designate a fuel injector arranged in the respective intake branch 2. Each branch 2 is connected to a common surge tank 5, and the surge tank 5 is connected to an air-cleaner 8, via an intake duct 6 and an air-flow meter 7. A throttle valve 9 is arranged in the intake duct 6. As shown in FIG. 1, the engine comprises a canister 11 in which an activated charcoal layer 10 is housed. The canister 11 has, on one side of the activated charcoal layer 10, a fuel vapor chamber 12 and, on another side of the layer 10, an air chamber 13. The fuel vapor chamber 12 is connected to, on one side, a fuel tank 15 via a conduit 14, and to, on another side, the surge tank 5 via a conduit 16. A purge control valve 17, which is cyclically opened and closed, is arranged in the conduit 16. The purge control valve 17 is controlled by signals output from an electronic control unit 20. Fuel vapor generated in the fuel tank 15 flows into the canister 11 via the conduit 14, and is adsorbed in the activated charcoal layer 10. When the purge control valve 17 is opened, an air flows from the air chamber 13 through the layer 10 into the conduit 16. During the air passes through the layer 10, fuel vapor adsorbed in the layer 10 is desorbed therefrom, and thus, air containing fuel vapor, namely, a purge gas, is fed into the surge tank 5. In this way, a purging operation is carried out.

The electronic control unit 20 is constructed as a digital computer and comprises a read-only memory (ROM) 22, a random-access memory (RAM) 23, the CPU (micro processor) 24, an input port 25, and an output port 26. ROM 22, RAM 23, CPU 24, the input port 25, and the output port 26 are interconnected to each other via a bidirectional bus 21. The air-flow meter 7 generates an output voltage in proportion to an amount of air sucked into the engine, and this output voltage is input to the input port 25 via an AD converter 27. A switch 28, which is turned ON when an opening of the throttle valve 9 is an idling opening, is connected to the throttle valve 9. The switch 28 generates a signal when the switch 28 is turned ON, and this signal is input to the input port 25. A water temperature sensor 29 generates an output voltage in proportion to a temperature of cooling water of the engine. The output voltage of the sensor 29 is input to the input port 25 via an AD converter 30. A air-fuel ratio sensor 31 is arranged in the exhaust manifold 3. The air-fuel ratio sensor 31 generates an output voltage in proportion to the air-fuel ratio of the engine. The output voltage of the sensor 31 is output to the input port 25 via an AD converter 32. The input port 25 is also connected to a crank angle sensor 33, which generates a pulse whenever a crankshaft is turned by, for example, 30 degrees. According to this pulses, the CPU 24 calculates the engine speed. The output port 26 is connected to the fuel injectors 4 and the purge control valve 17 via respective drive circuits 34 and 35.

In the engine shown in FIG. 1, a fuel injector time TAU is basically calculated using a following equation:

$$TAU=TP\cdot\{1+KK+(FAF-1)+FPG\}$$

where

TP: basic fuel injection time

KK: enrichment coefficient

FAF: feedback correction coefficient

FPG: purge correction coefficient

The basic fuel injection time TP is a fuel injection time required to make an air-fuel ratio of air-fuel mixture fed into the engine equal to a target air-fuel ratio, and is previously obtained by experiments. This basic fuel injection time TP is stored in advance in the ROM 22 as a function of an engine speed N and an engine load Q/N (an amount of air Q/the engine speed N).

The enrichment coefficient KK is a coefficient for increasing the amount of fuel to be fed into the engine at the time of warm-up of the engine or at the time of acceleration of the engine. This enrichment coefficient KK is made zero when the increase operation of the amount of fuel is not required.

The purge correction coefficient FPG is a coefficient for correcting the amount of fuel to be fed during the purging operation. The purge correction coefficient FPG is made zero when the purging operation is stopped.

The feedback correction coefficient FAF is a coefficient for correcting the amount of fuel to be fed to make the air-fuel ratio equal to the target air-fuel ratio, based on signals output from the air-fuel ratio sensor 31. While any air-fuel ratio can be used for the target air-fuel ratio, the target air-fuel ratio in this embodiment is a stoichiometric air-fuel ratio. Accordingly, the description hereinafter is related in the case when the target air-fuel ratio is the stoichiometric air-fuel ratio. When the stoichiometric air-fuel ratio is used as the target air-fuel ratio, the air-fuel ratio sensor 31 is constructed by a sensor, output voltage of which varies in accordance with a concentration of oxygen in the exhaust gas. Therefore, the air-fuel ratio sensor 31 is referred as an oxygen sensor, hereinafter. The oxygen sensor 31 outputs a voltage of approximately 0.9 volts when the air-fuel ratio is on the rich side of the stoichiometric air-fuel ratio, and of approximately 0.1 volts when the air-fuel ratio is on the lean side of the stoichiometric air-fuel ratio. Next, a control of the feedback correction coefficient FAF based on the output signals of the oxygen sensor 31 will be explained.

Figure 2:
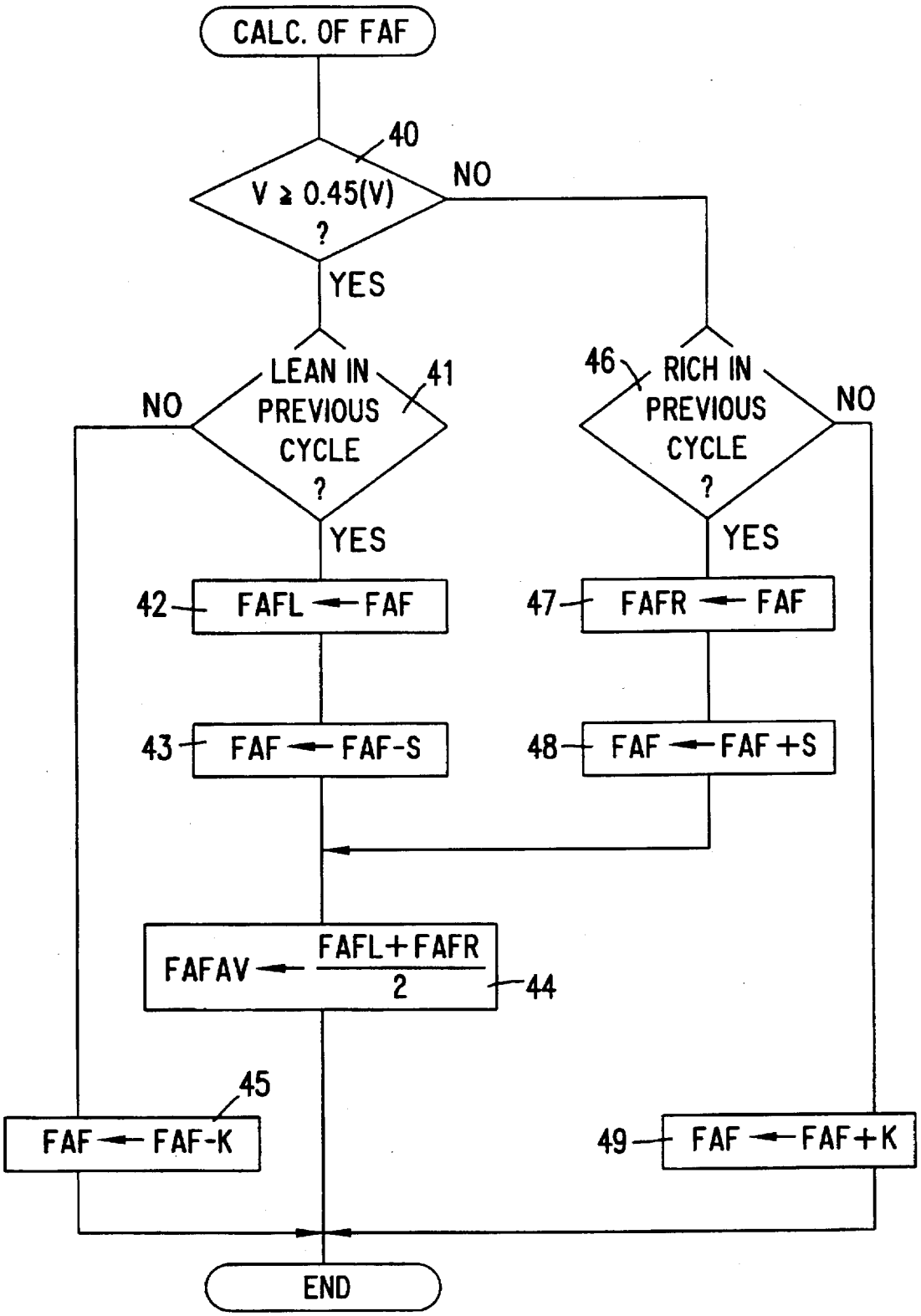
FIG. 2 is a flowchart for calculating a feedback correction coefficient.

FIG. 2 shows a routine for calculating the feedback correction coefficient FAF. This routine is executed in, for example, a main routine of the engine.

Figure 3:
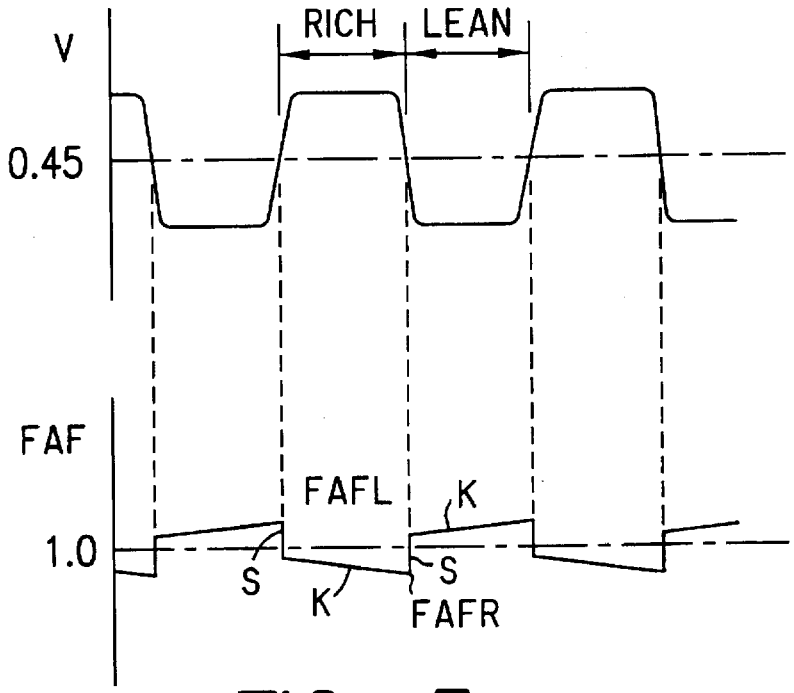
FIG. 3 is a diagram illustrating a variation in a feedback correction coefficient.

Referring to FIG. 2, first, in step 40, it is determined whether the output voltage V of the oxygen sensor 31 is higher than 0.45 V, namely, whether the air-fuel ratio is on the rich side of the stoichiometric air-fuel ratio. If $V \geqq 0.45$ V, namely, if the air-fuel ratio is on the rich side of the stoichiometric air-fuel ratio, the routine goes to step 41, where it is determined whether the air-fuel ratio was on the lean side of the stoichiometric air-fuel ratio in the previous processing cycle. If it is determined that the air-fuel ratio was on the lean side in the previous processing cycle, namely, if it is determined that the air-fuel ratio changes from the lean side to the rich side, the routine goes to step 42, where the feedback correction coefficient FAF is memorized as FAFL. In following step 43, the skip value S is subtracted from the feedback correction coefficient FAF, and thereby the feedback correction coefficient FAF is drastically decreased, as shown in FIG. 3. In following step 44, the average of FAFL and FAFR is memorized as FAFAV. Then, the processing cycle is ended.

Conversely, if it is determined, in step 41, that the air-fuel ratio was on the rich side of the stoichiometric air-fuel ratio in the previous processing cycle, the routine goes to step 45, where the integral value K (K α S) is subtracted from the feedback correction coefficient FAF. In this case, the feedback correction coefficient FAF is gradually decreased, as shown in FIG. 3.

If it is determined in step 40 that V<0.45 V, namely, if it is determined that the air-fuel ratio is on the lean side of the stoichiometric ratio, the routine goes to step 46, where it is determined whether the air-fuel ratio was on the rich side in the previous processing cycle. If it is determined that the air-fuel ratio was on the rich side in the previous processing cycle, namely if it is determined that the air-fuel ratio changes from the rich side to the lean side, the routine goes to step 47, the feedback correction coefficient FAF is memorized as FAFR. In following step 48, the skip value S is added to the feedback correction coefficient FAF, and thereby, the feedback correction coefficient FAF is drastically increased, as shown in FIG. 3. In the following step 44, the average of FAFL and FAFR is memorized as FAFAV. Then, the processing cycle is ended. Conversely, if it is determined, in step 46, that the air-fuel ratio was on the lean side of the stoichiometric air-fuel ratio in the previous processing cycle, the routine goes to step 49, where the integral value K is added to the feedback correction coefficient FAF. In this case, the feedback correction coefficient FAF is gradually increased, as shown in FIG. 3.

When the air-fuel ratio becomes on the rich side and thereby the feedback correction coefficient increases, the fuel injection time TAU is made shorter. When the air-fuel ratio becomes on the lean side and thereby the feedback correction coefficient decreases, the fuel injection time TAU is made longer. As a result, the air-fuel ratio is maintained to the target, stoichiometric air-fuel ratio. In this connection, the feedback correction coefficient FAF alternatively increases and decreases relative to 1.0, when the purging operation is stopped. Further, the value FAFAV calculated in step 44 represents the average of the feedback correction coefficient, as can be understood from FIG. 3.

As shown in FIG. 3, the feedback correction coefficient FAF is caused to be changed, using the integral value K, relatively slowly. Therefore, if the amount of the purge gas fed into the engine drastically increases and thereby the air-fuel ratio drastically varies, it is no longer possible to keep the air-fuel ratio equal to the stoichiometric air-fuel ratio, namely, the air-fuel ratio fluctuates. To prevent such a fluctuation, this embodiment increases the amount of the purge gas gradually at the beginning of the purging operation.

If the engine is, for example, accelerated during the purging operation, the amount of air fed into the engine increases, and the amount of the purge gas decreases, because a negative pressure is produced in the surge tank 5. This causes, however, the concentration of fuel vapor in air fed into the engine to vary drastically, and thereby the air-fuel ratio fluctuates, even when the amount of the purge gas is gradually increased. To prevent such a fluctuation of the air-fuel ratio during an engine transient operation, this embodiment introduces a reference purge ratio determined in accordance with the engine operating condition, for example, a maximum purge ratio MAXPG, and controls the amount of the purge gas by controlling the opening ratio of the purge control valve 17 in accordance with a ratio of the target purge ratio to the maximum purge ratio. Next, the control of the amount of the purge gas will be explained.

Figure 4A:
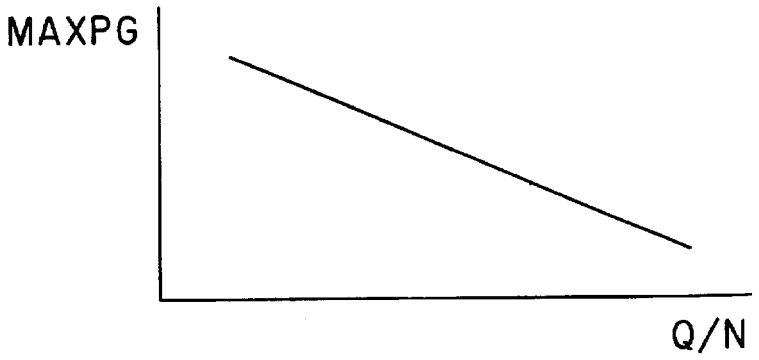
FIGS. 4A through 4C are diagram illustrating a maximum purge ratio.
Figure 4B:
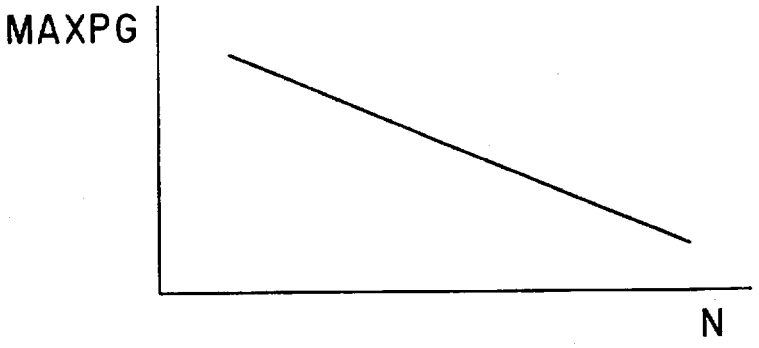
Figure 4C:
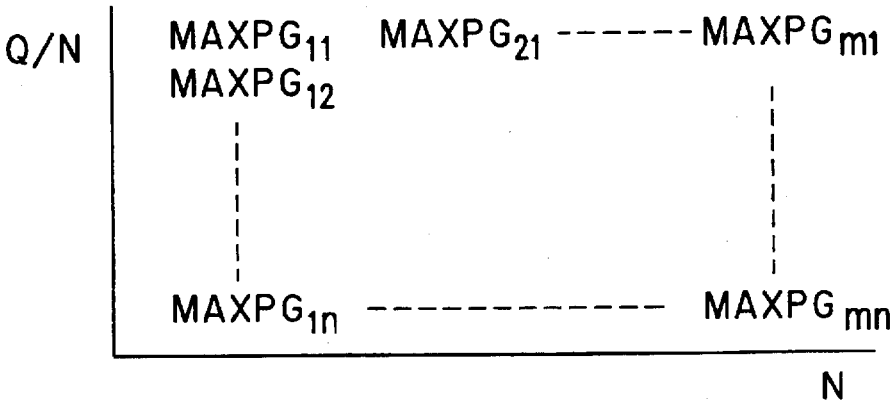

The maximum purge ratio MAXPG is a ratio of the amount of the purge gas when the purge control valve 17 is fully opened, to that of air fed into the engine. As illustrated in FIG. 4A, this maximum purge ratio MAXPG becomes smaller when the engine load A/N becomes larger, with the constant engine speed N, and becomes smaller when the engine speed N becomes larger, with the constant engine load Q/N, as illustrated in FIG. 4B. The relationship between the maximum purge ratio MAXPG and the engine speed N and the engine load Q/N is stored in advance in the ROM 22 in the form of the map as shown in FIG. 4C. When the purging operation is to be started, first, the target purge ratio TGTPG is gradually increased at a constant rate, and when the target purge ratio TGTPG leaches a predetermined ratio, such as 4% the target purge ratio TGTPG is maintained at 4%. The opening ratio of the purge control valve is controlled in accordance with the ratio of the target purge ratio TGTPG to the maximum purge ratio MAXPG. In this embodiment, when the purging operation is to be carried out, the opening ratio of the purge control valve 17 is controlled by controlling a duty ratio, and the duty ratio is controlled in accordance with a ratio of the target purge ratio TGTPG to the maximum purge ratio MAXPG. The duty ratio is defined as a ratio of a period during which the purge control valve is opened to a duty cycle time, in each duty cycle. In this connection, the maximum purge ratio MAXPG is calculated in accordance with the engine operating condition, and therefore, the duty ratio is also calculated in accordance with the engine operating condition.

Namely, when the concentration of fuel vapor in the purge gas is constant, the concentration of fuel vapor in air fed into the engine is in proportion to the maximum purge ratio MAXPG. Therefore, to make the concentration of fuel vapor in air fed into the engine constant, the opening of the purge control valve 17 is required to be increased and thereby the amount of the purge gas increases, when the maximum purge ratio MAXPG becomes smaller. In other words, when the target purge ratio TGTPG is set as constant, the concentration of fuel vapor in the air fed into the engine becomes constant regardless the engine operating condition, by controlling the opening ratio of the purge control valve 17 in accordance with the ratio of the target purge ratio TGTPG to the maximum purge ratio MAXPG. Therefore, the air-fuel ratio is preventing from fluctuating, even during the engine transient operation.

On the other hand, when the target purge ratio TGTPG is increased gradually, the concentration of fuel vapor in air fed into the engine increases in proportion to the target purge ratio TGTPG, even when the engine transient operation is carried out. Namely, when the target purge ratio TGTPG is the same, the concentration of fuel vapor in air fed into the engine is not effected by the engine operating condition. Accordingly, the air-fuel ratio is prevented from fluctuating, even during the transient engine operation, and is maintained at the stoichiometric air-fuel ratio by the feedback control using the feedback correction coefficient FAF.

When the purging operation starts, the feedback correction coefficient FAF becomes smaller to make the air-fuel ratio equal to the stoichiometric air-fuel ratio, and thus, the average FAFAV becomes gradually smaller. In this condition, the decrement of the feedback correction coefficient FAF becomes larger when the concentration of fuel vapor in air fed into the engine becomes higher, and the decrement of the feedback correction coefficient FAF is in proportion to the concentration of fuel vapor in air fed into the engine. Therefore, the concentration of fuel vapor in air fed into the engine can be obtained from the decrement of the feedback correction coefficient FAF. As described above, the concentration of fuel vapor in air fed into the engine is not affected by the engine transient operation, and is in proportion to the target purge ratio TGTPG.

On the other hand, the concentration of fuel vapor in air fed into the engine is in proportion to the product of a concentration of fuel vapor per unit purge ratio and the target purge ratio. Accordingly, when the feedback correction coefficient FAF decreases, correcting the amount of fuel to be injected in accordance with the concentration of fuel vapor in air fed into the engine, or with the product of the target purge ratio and the concentration of fuel vapor per the unit target purge ratio, maintains the air-fuel ratio to the stoichiometric air-fuel ratio, regardless whether the engine operating condition is transient. This embodiment introduces a fuel vapor concentration coefficient FGPG representing a concentration of fuel vapor in air fed into the engine per unit purge ratio, and corrects the amount of fuel to be injected in accordance with the product of the fuel vapor concentration coefficient FGPG and the purge ratio PRG corresponding to the target purge ration TGTPG. Next, the correction of the amount of fuel to be injected based on the concentration of fuel vapor will be further explained.

Figure 5:
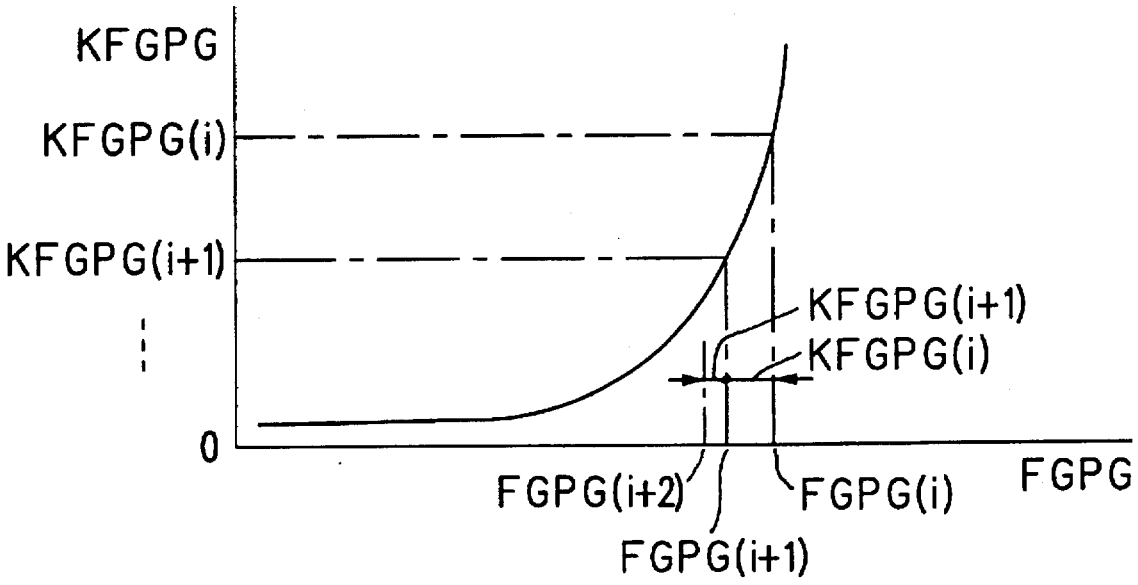
FIG. 5 is a diagram illustrating a relationship between a fuel vapor concentration coefficient and a decrement thereof.

In this embodiment, to reduce the deviation of the fuel vapor concentration coefficient from the actual fuel vapor concentration per unit purge ratio, the fuel vapor amount coefficient FGPG is renewed whenever the amount of the purge gas purged into the engine is a predetermined amount, such as 1 liter. Considering an open-loop control during which the feedback correction coefficient FAF is fixed, it is undesirable that the decrement of the feedback correction coefficient FAF is too large. On the other hand, if the fuel vapor concentration coefficient FGPG is known in advance when the fuel vapor concentration coefficient is to be renewed, it is possible to prevent the feedback correction coefficient from deviating largely from the reference value thereof. According to the inventors of the present invention, it has been found that the relationship between the fuel vapor concentration coefficient FGPG and a decrement of the fuel vapor concentraton coefficient KFGPG caused when the purge gas is purged by a predetermined amount QP, is as shown in FIG. 5. Therefore, in this embodiment, the fuel vapor concentration coefficient FGPG is periodically renewed using the relationship shown in FIG. 5. The decrement KFGPG becomes smaller when the fuel vapor concentration coefficient FGPG become smaller, as shown in FIG. 5. This relationship is stored in advance in the ROM 22, in the form of a map as shown in FIG. 5. Next, renewing of the fuel vapor concentration coefficient FGPG using the map shown in FIG. 5 will be explained.

Figure 6:
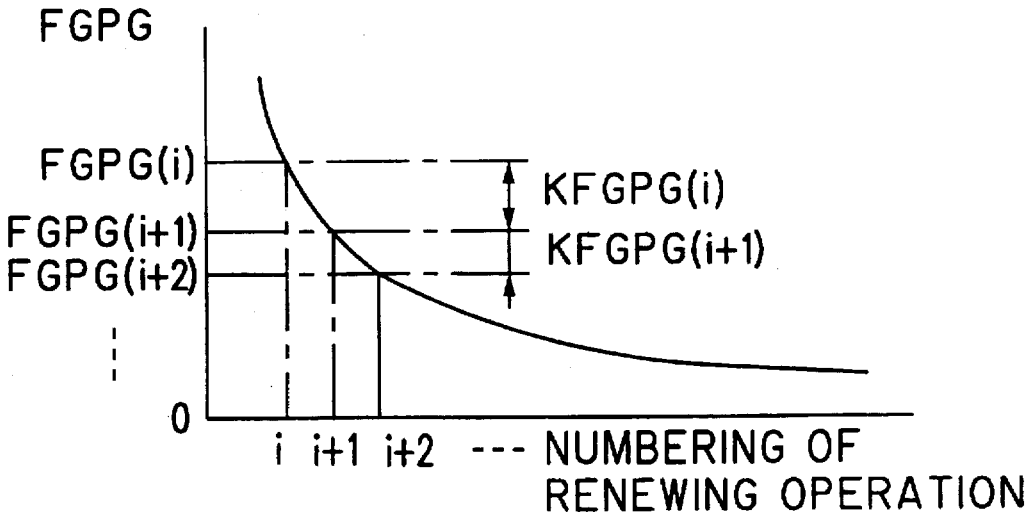
FIG. 6 is a diagram illustrating a variation in a fuel vapor concentration coefficient.

FGPG(i) is a fuel vapor concentration coefficient FGPG obtained at the i th renewing operation thereof. In the condition in which FGPG=FGPG(i), if the purge gas is purged by the predetermined amount QP, the fuel vapor concentration coefficient FGPG decreases by KFGPG(i), as can be seen in FIG. 5. Namely, the fuel vapor concentration coefficient FGPG(i+1) in this condition is FGPG(i)–KFGPG (i), as shown in FIGS. 5 and 6. In the condition in which FGPG=FGPG(i+1), if the purge gas is purged by the predetermined amount QP, the fuel vapor concentration coefficient FGPG decreases by KFGPG(i+1), and thus FGPG(i+2)=FGPG(i+1)–KFGPG(i+1). Accordingly, the fuel vapor concentration coefficient FGPG is obtained before purging the purge gas by the predetermined amount QP, by calculating periodically the decrement KFGPG of the fuel vapor concentration coefficient FGPG, in accordance with the current fuel vapor concentration coefficient FGPG, whenever the purge gas is purged by the predetermined amount, and by subtracting the decrement KFGPG from the current fuel vapor concentration coefficient FGPG. Therefore, if an initial value of fuel vapor concentration coefficient FGPG(0) is obtained, it is possible to calculate the current fuel vapor concentration coefficient FGPG using the map shown in FIG. 5.

Next, the method for calculating the initial value FGPG (0) will be explained.

When the purging operation starts, the feedback correction coefficient FAF decreases until it becomes a value corresponding to the concentration of fuel vapor in air fed into the engine. However, the feedback correction coefficient FAF may also decrease due to other causes, for example, a measuring error of the air flow meter 7. Therefore, it is required to determine whether the cause of decreasing the feedback correction coefficient FAF is the purging operation. The decrement of the feedback correction coefficient FAF due to the purging operation is larger than that due to the other causes. However, as mentioned above, the decrement of the feedback correction coefficient FAF should not be too large. Therefore, this embodiment limits the decreasing of the feedback correction coefficient FAF when the feedback correction coefficient FAF falls below a lower threshold (FBA–X) after the purging operation starts, and gradually increases the fuel vapor concentration coefficient FGPG from zero, while limiting a fall in the feedback correction coefficient FAF.

To prevent for the feedback correction coefficient FAF from falling below the lower threshold (FBA–X) as much as possible, this embodiment increases the fuel vapor concentration coefficient FGPG when the feedback correction coefficient FAF is lower than the lower threshold (FBA–X) and when the air-fuel ratio is on the rich side. As mentioned above, the purge correction coefficient FPG is represented by the negative value of the product of the purge ratio and the fuel vapor concentration coefficient FGPG representing the fuel vapor concentration in air per unit purge ratio, namely FPG=–FGPG·PRG. Therefore, if the fuel vapor concentration coefficient FGPG increases, the amount of fuel to be injected is reduced, as can be understood from the TAU calculating equation. In other words, when the fuel vapor concentration coefficient FGPG increases, the amount of fuel to be injected is reduced, and thereby the fall in the feedback correction coefficient FAF is limited.

In this embodiment, the fuel vapor concentration coefficient FGPG is increased when the feedback correction coefficient FAF decreases below the lower threshold (FBA–X) and when the air-fuel ratio is on the rich side. In this operation, when the feedback correction coefficient FAF increases to thereby increase the amount of fuel to be injected, the fuel vapor concentration coefficient FGPG is kept constant, and thus the reduction in the amount of fuel to be injected is stopped. Accordingly, the air-fuel ratio is rapidly controlled to the stoichiometric air-fuel ratio. Therefore, the air-fuel ratio is prevented from fluctuating, except just after the purging operation starts. After this, the feedback correction coefficient FAF generally increases gradually, while the air-fuel ratio is kept at the stoichiometric air-fuel ratio. And, after a short time, the feedback correction coefficient FAF is kept at about 1.0. At this time, the fuel vapor concentration coefficient FGPG is kept constant.

As mentioned above, the decrement of the feedback correction coefficient FAF is in proportion to the fuel vapor concentration in air fed into the engine. On the other hand, the fuel vapor concentration coefficient FGPG decreases by the value by which the feedback correction coefficient FAF should decrease. Accordingly, the fuel vapor concentration in air is represented by a sum of the decrement of the feedback correction coefficient FAF and the product of the fuel vapor concentration coefficient FGPG and the purge ration PRG.

Figure 7:
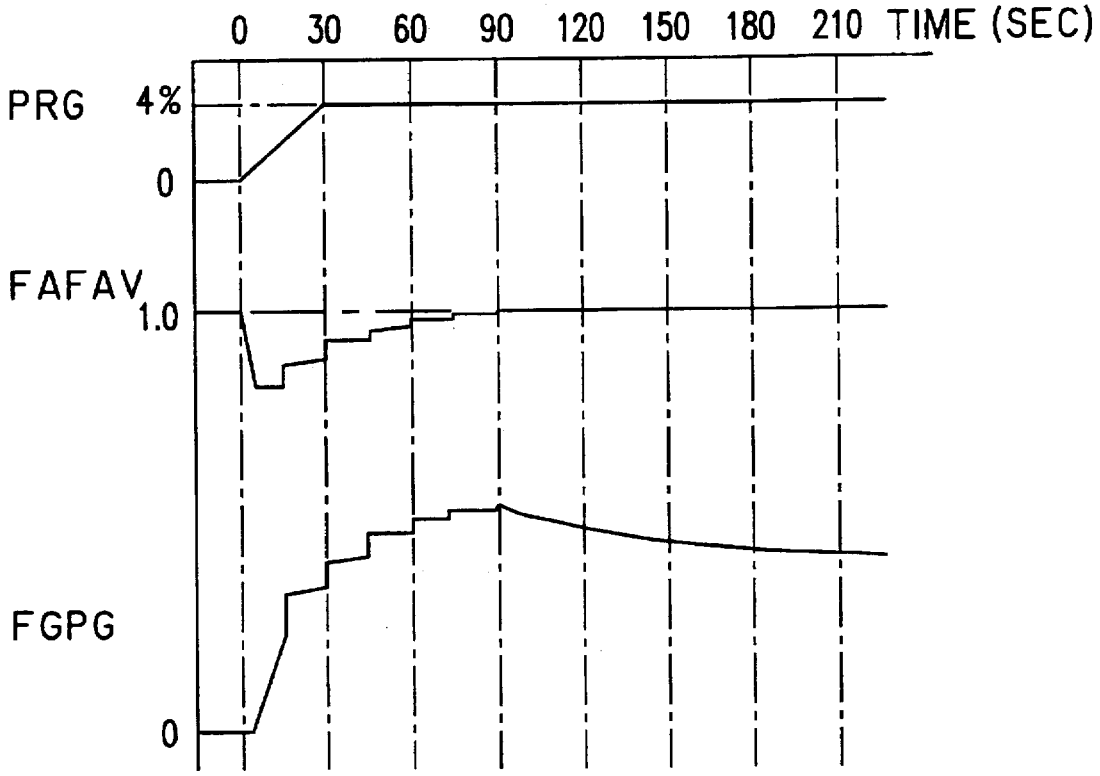
FIG. 7 is a timechart illustrating variations in a purge ratio, the average of a feedback correction coefficient, and a fuel vapor concentration coefficient, during a purging operation.

In a timechart shown in FIG. 7, the time zero is the time when the purging operation starts. As shown in FIG. 7, this embodiment gradually increases the target purge ratio TGTPG when the purging operation starts to thereby prevent the air-fuel ratio from largely deviating from the stoichiometric air-fuel ratio. In the example of FIG. 7 wherein the purge ratio PRG corresponding to the target purge ratio TGTPG is set as a maximum at about 30 sec after the purging operation starts, the fuel vapor concentration coefficient FGPG becomes steady at about 15 sec after the purging operation starts.

As mentioned above, the feedback correction coefficient FAF should be kept 1.0. Therefore, the average of the feedback correction coefficient FAFAV is made close to 1.0 gradually, at every 15 sec intervals. As mentioned above, the fuel vapor concentration in the air is represented by the sum of the decrement of the feedback correction coefficient FAF and the product of the fuel vapor concentration coefficient FGPG and the purge ratio PRG. Therefore, when the feedback correction coefficient FAF must be increased, the fuel vapor concentration coefficient FGPG must also be increased by a value corresponding to the increment of the feedback correction coefficient FAF. Accordingly, when the feedback correction coefficient FAF is returned to 1.0, the fuel vapor concentration coefficient FGPG correctly represents the fuel vapor concentration per the unit purge ratio. In this embodiment, the fuel vapor concentration coefficient FGPG when the feedback correction coefficient FAF is returned within a predetermined range, namely when $1-Z \leqq FAF \leqq 1+Z$ (where Z is a small constant), is used for the initial value FGPG(0). In this connection, when the feedback correction coefficient FAF, or the average thereof FAFAV is made equal to about 1.0, the product FGPG·PRG correctly represents the fuel vapor concentration in the air.

After the initial value FGPG(0) is obtained, namely, after 90 sec has passed since the purging operation started in the example shown in FIG. 7, the renewing operation of the fuel vapor concentration coefficient FGPG is carried out using the map shown in FIG. 5. Namely, after 90 sec has passed since the purging operation started, the fuel vapor concentration coefficient FGPG is gradually decreased by the decrement KFGPG determined in accordance with FGPG, as shown in FIG. 7. When the renewing operation of the fuel vapor concentration coefficient FGPG using the map shown in FIG. 5 is carried out, the calculating of the fuel vapor concentration coefficient FGPG in accordance with the deviation of the feedback correction coefficient FAF is stopped.

Figure 8:
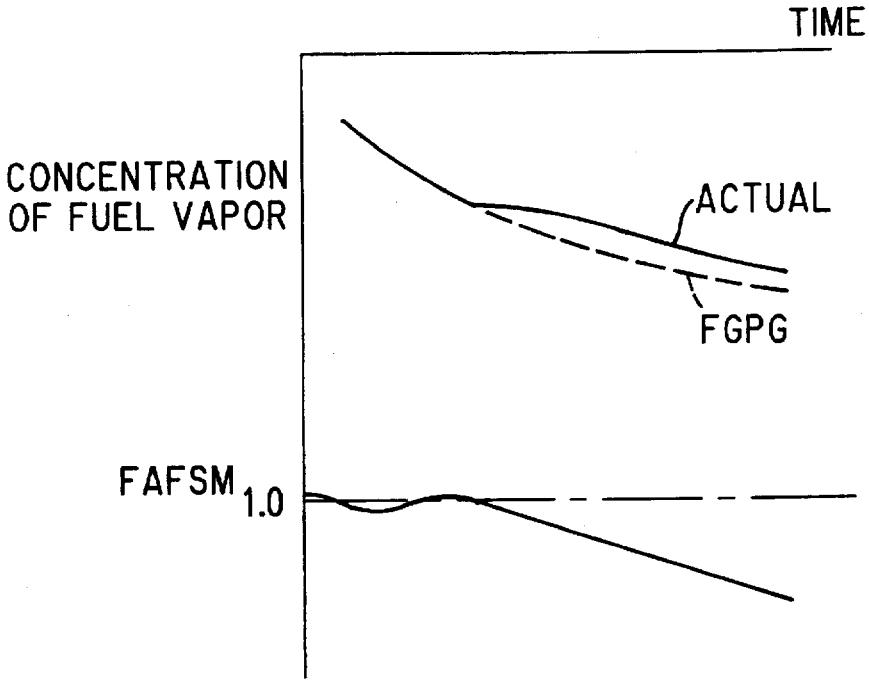
FIG. 8 is a timechart for explaining a condition in which a fuel vapor concentration coefficient deviates from an actual fuel vapor concentration per unit purge ratio.

Even during the purging operation, fuel vapor generated in the fuel tank 15 is continuously introduced into the canister 11. In this condition, a part of fuel vapor introduced into the canister 11 is purged into the intake passage after it is temporarily stored in the canister 11, and the remainder is purged into the surge tank 5 without being temporarily stored in the canister 11. In this condition, when the amount of fuel vapor generated in the fuel tank 15 increases slightly due to the temperature rise in fuel in the fuel tank 15, the amount of fuel vapor adsorbed in the activated charcoal layer 10 increases, and thereby the relationship between the current fuel vapor concentration coefficient FGPG and the decrement KFGPG thereof is prevented from deviating from that shown in FIG. 5. However, when the increment of the amount of fuel vapor is too large, or when the adsorbability of the activate charcoal layer 10 is lowered, namely, the layer 10 is saturated, while the amount of fuel vapor generated in the fuel tank 15 increases, almost all of fuel vapor introduced into the canister 11 is purged into the surge tank 5 without being temporarily adsorbed in the activated charcoal layer 10. In this condition, the actual decrement of the fuel vapor concentration in air per unit purge ratio, caused when the purge gas is purged by the predetermined amount QP, becomes smaller than the decrement of the fuel vapor concentration coefficient KFGPG obtained using the map shown in FIG. 5. Namely, the relationship between the current fuel vapor concentration coefficient FGPG and the decrement thereof KFGPG becomes different from that shown in FIG. 5. Therefore, the fuel vapor concentration coefficient FGPG calculated in this condition is smaller than the actual fuel vapor concentration per unit purge ratio, as shown in a timechart of FIG. 8. As a result, the purge correction coefficient FPG becomes smaller than a value required to make the air-fuel ratio equal to the stoichiometric air-fuel ratio, and thus the weighted mean of the feedback correction coefficient FAFSM deviates from 1.0, as shown in FIG. 8. Accordingly, the air-fuel ratio deviates to the rich side. In this situation, the feedback correction coefficient FAF decreases to maintain the air-fuel ratio at the stoichiometric air-fuel ratio. However, the feedback correction coefficient FAF is gradually decreased by the integral value K, a constant. Therefore, it is no longer possible to maintain the air-fuel ratio at the stoichiometric air-fuel ratio. Further, if the renewing operation of the fuel vapor concentration coefficient FGPG using the relationship shown in FIG. 5 is continued even when the relationship between FGPG and KFGPG deviates from that shown in FIG. 5, the deviation of the weighted mean FAFAV from 1.0 continuously increases.

In other words, when the renewing operation of the fuel vapor concentration coefficient FGPG is carried out, if the feedback correction coefficient FAF deviates from 1.0 in a certain degree, it is determined that the relationship between the current fuel vapor concentration coefficient FGPG and the decrement thereof KFGPG deviates from that shown in FIG. 5. Therefor, this embodiment temporarily stops the renewing operation of the fuel vapor concentration coefficient FGPG using the map shown in FIG. 5, when the weighted mean of the feedback correction coefficient FAFSM is out of a predetermined range, namely when the weighted means FAFSM is smaller than a lower threshold LT or is larger than an upper threshold UT. This prevents the fuel vapor concentration coefficient FGPG from decreasing when the actual fuel vapor concentration per unit purge ratio increases.

When the renewing operation of FGPG is stopped, this embodiment calculates the fuel vapor concentration coefficient FGPG in accordance with the deviation of the feedback correction coefficient FAF. This makes the fuel vapor concentration coefficient FGPG equal to the actual fuel vapor concentration per unit purge ratio. Accordingly, the air-fuel ratio is rapidly returned to the stoichiometric air-fuel ratio. When the weighted means FAFSM is returned within the predetermined range, namely when $1-Z \leqq FAFSM \leqq 1+Z$, the renewing operation using FIG. 5 is again carried out.

Next, the control of the purging operation will be further explained with reference to FIGS. 9 to 13.

Figure 9:
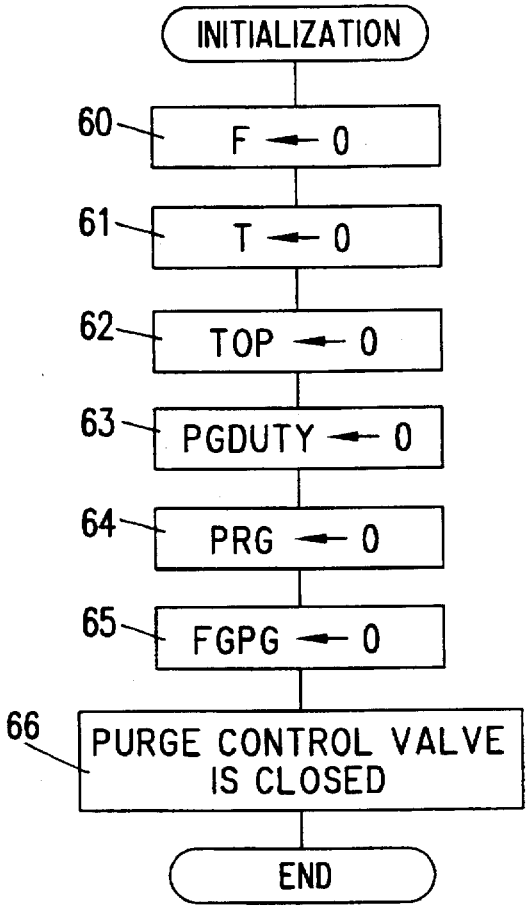
FIG. 9 is a flowchart for executing an initialization.

FIG. 9 illustrates a routine for executing an initialization. This routine is carried out once when an ignition switch (not shown) of the engine is turned ON.

Referring to FIG. 9, first, in step 60, a purge control factor F is made zero. This purge control factor F is selectively made one of zero, 1, and 2, and is made zero when the purging operation is to be stopped, and is made 1 or 2 when the purging operation is to be carried out. Further, the factor F is made 1 when the initial value FGPG(0) of the fuel vapor concentration coefficient FGPG is not calculated, and is made 2 after the initial value FGPG(0) has calculated. In following step 61, a counter value T is cleared. In following step 62, a integrated amount of the purge gas QP, which is an amount of the purge gas purged after each of the renewing operation of the fuel vapor concentration coefficient FGPG is carried out, is made zero. In following steps 63 and 64, the duty ratio PGDUTY of the purge control valve 17, and the purge ratio PRG are made both zero. In following step 65, the fuel vapor concentration coefficient FGPG is made zero. In following step 66, the purge control valve 17 is closed, and then the processing cycle is ended.

FIGS. 10 to 14 illustrate a routine for controlling the purging operation. This routine is executed by interruption every predetermined time, such as every 100 ms.

Figure 10:
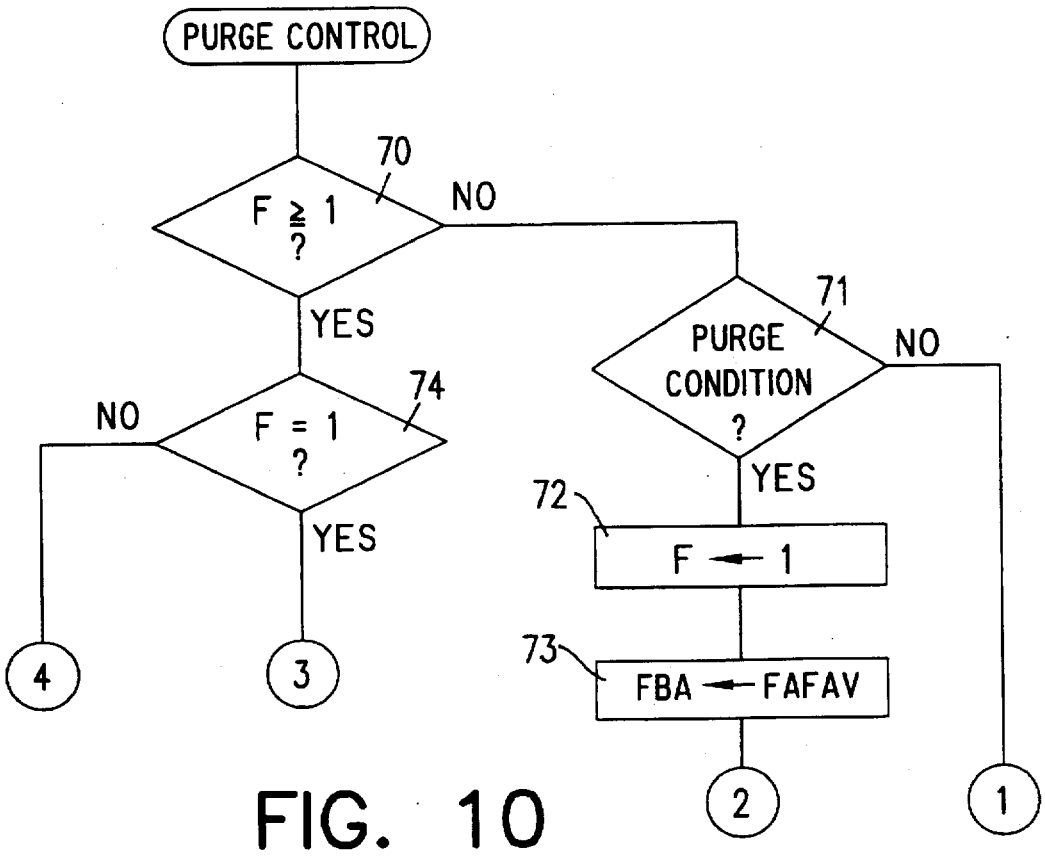
FIGS. 10 through 13 are a flowchart for controlling a purging operation.

Referring to FIG. 10, first, in step 70, it is determined whether the purge control factor F is equal to or more than 1. If it is a first time for the routine to go to step 70 after the ignition switch is turned ON, F=0, and thus the routine goes to step 71. In step 71, it is determined whether a condition in which the purging operation can be carried out is established. In this embodiment, it is determined that the purge condition is established when the temperature of the engine cooling water is above 70° C., the feedback control of the air-fuel ratio is started, and the skipping operation of the feedback correction coefficient FAF (S as shown in FIG. 3) is carried out more than five times. If it is determined that the purge condition is not established, the processing cycle is ended. Contrarily, if it is determined that the purge condition is established, the routine goes to step 72, where the purge control factor F is made 1. In following step 73, the average of the feedback correction coefficient FAFAV calculated in the routine shown in FIG. 2 is memorized as FBA. Accordingly, FBA represents the average of the feedback correction coefficient FAFAV when the purge condition is established. Then, the routine goes to step 101 shown in FIG. 13. Steps 101 to 109 are for setting the opening ratio of the purge control valve 17, and the explanation thereof will follow. Namely, the purging operation starts after the purge condition is established.

In the next processing cycle after the factor F is made 1, the routine goes from step 70 to step 74, where it is determined whether the factor F is made 1. If it is a first time for the routine to go to step 74 after the purging operation starts, the factor F is made 1, and then the routine goes to step 75 as shown in FIG. 11.

Figure 11:
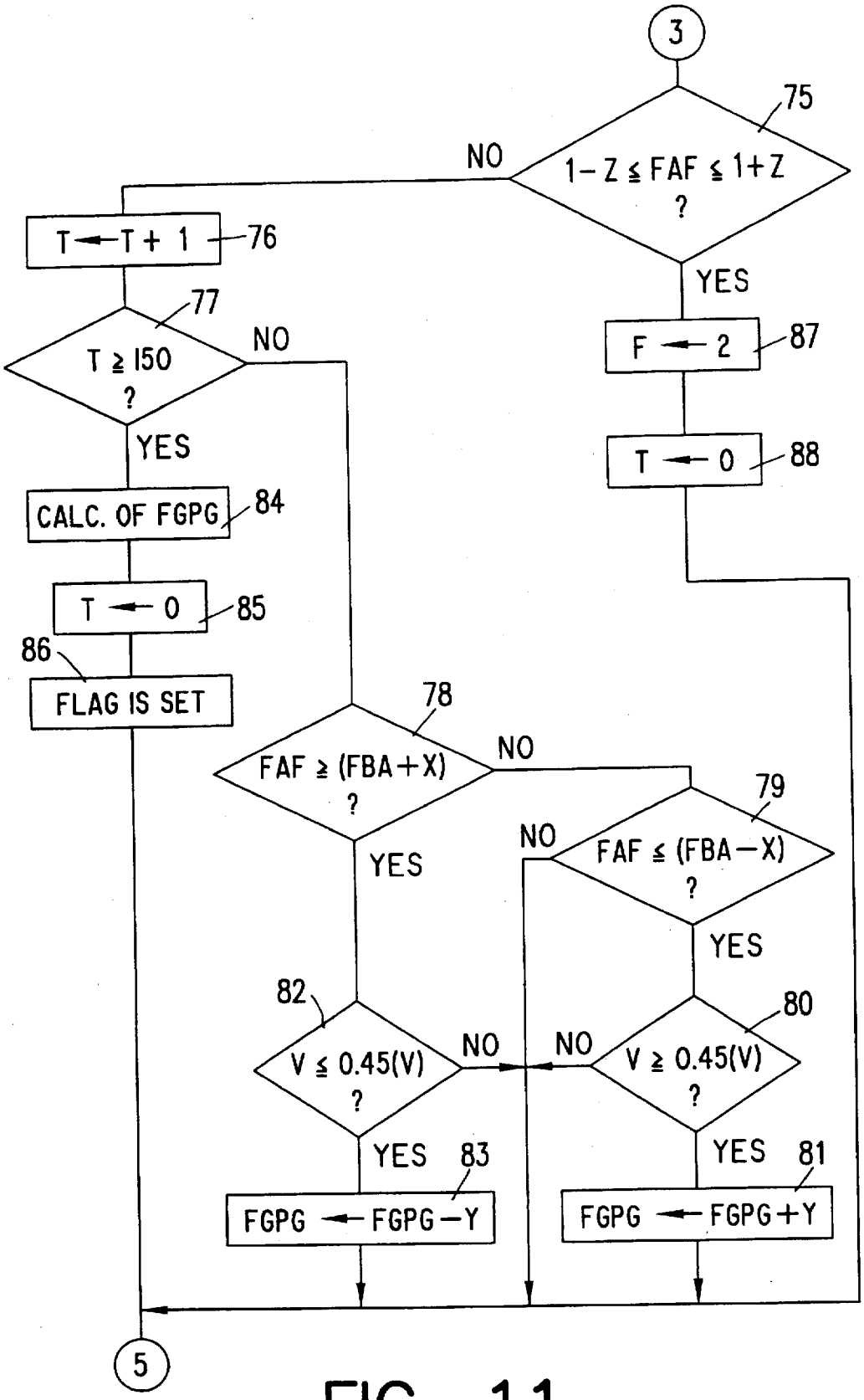

In step 75 in FIG. 11, it is determined whether the feedback correction coefficient FAF is within the predetermined range, namely, whether $1-Z \leqq FAF \leqq 1+Z$. As explained above with reference to FIG. 7, when the purging operation starts, the feedback correction coefficient FAF decreases drastically, and becomes below 1–Z. In this condition, the routine goes from step 75 to step 76.

Steps 76 to 88 are for calculating the initial value of the fuel vapor concentration coefficient FGPG in accordance with the deviation of the feedback correction coefficient FAF. In step 76, the counter value T is incremented by 1. In following step 77, it is determined whether the counter value T is larger than 150. If it is a first time for the routine to go to step 77 after the purging operation starts, T<150, and thus the routine goes to step 78. In step 78, it is determined whether the feedback correction coefficient FAF is equal to or larger than an upper threshold (FBA+X), where FBA is an average of the feedback correction coefficient FAFAV when the purging operation starts, and X is a small constant. If FAF<(FBA+X), the routine goes to step 79.

In step 79, it is determined whether the feedback correction coefficient FAF is equal to or smaller than the lower threshold (FBA–X). If FAF>(FBA–X), the routine goes to step 101 in FIG. 11. If FAF≦(FBA–X), the routine goes to step 80, where it is determined whether the output voltage V of the oxygen sensor 31 is equal to or higher than 0.45 Volts, namely, whether the air-fuel ratio is on the rich side of the stoichiometric air-fuel ratio. If V≧0.45 V, namely, if the air-fuel ratio is on the rich side, the routine goes to step 81, where a constant Y is added to the fuel vapor concentration coefficient FGPG. Accordingly, when FAF≦(FBA–X) and when the air-fuel ratio is on the rich side, the fuel vapor concentration coefficient FGPG is increased by the constant Y. Then, the routine goes to step 101 in FIG. 13. If V<0.45 V, namely, if the air-fuel ratio is on the lean side, in step 80, the routine goes to step 101 in FIG. 13.

Contrarily, if FAF≧(FBA+X), in step 78, the routine goes to step 82, where it is determined whether the output voltage V of the oxygen sensor 31 is equal to or lower then 0.45 V, namely, whether the air-fuel ratio is on the lean side of the stoichiometric air-fuel ratio. If V≦0.45 V, namely, if the air-fuel ratio is on the lean side, the routine goes to step 83, where a constant Y is subtracted from the fuel vapor concentration coefficient FGPG. Accordingly, when FAF≧(FBA–X) and when the air-fuel ratio is on the lean side, the fuel vapor concentration coefficient FGPG is decreased by the constant Y. This prevents the air-fuel ratio from fluctuating after the feedback correction coefficient FAF increases over the upper threshold (FBA+X). Then, the routine goes to step 101 in FIG. 13. If V<0.45 V, namely, if the air-fuel ratio is on the rich side, in step 82, the routine goes to step 101 in FIG. 13.

Contrarily, if T≧150 in step 77, namely, if 15 sec has passed since the purging operation started, the routine goes to step 84, where the fuel vapor concentration coefficient FGPG is calculated using the following equation:

$$FGPG=FGPG-(FAFAV-FBA)/(PRG\cdot 2)$$

Namely, a half of the difference between the average of the feedback correction coefficient FAFAV at this time and that at the start of the purging operation per unit purge ratio PRG is subtracted from the fuel vapor concentration coefficient FGPG. In other words, half of the change of the feedback correction coefficient FAF per unit purge ratio PRG is subtracted from FGPG. Then, the routine goes to step 85 and the counter value T is cleared. Accordingly, the routine goes to step 84 every 15 sec. In following step 86, a flag, which is set when the fuel vapor concentration coefficient FGPG has calculated in step 84, is set. Then, the routine goes to step 101 in FIG. 13.

By renewing the fuel vapor concentration coefficient FGPG using steps 76 to 86, the feedback correction coefficient FAF is gradually made close to 1. If it is determined, in step 75, that the feedback correction coefficient FAF is within the predetermined range, the routine goes to step 87. As mentioned above, the fuel vapor concentration coefficient FGPG when the feedback correction coefficient FAF is returned to about 1 after the purging operation starts, FGPG correctly represents the fuel vapor concentration pre unit purge ratio, and FGPG at this time is made the initial value of FGPG. Therefore, if $1-Z \leqq FAF \leqq 1+Z$, in step 75, the routine goes to step 87, where the factor F is made 2. In following step 88, the counter value T is cleared. Then, the routine goes to step 101 in FIG. 101.

Figure 12:
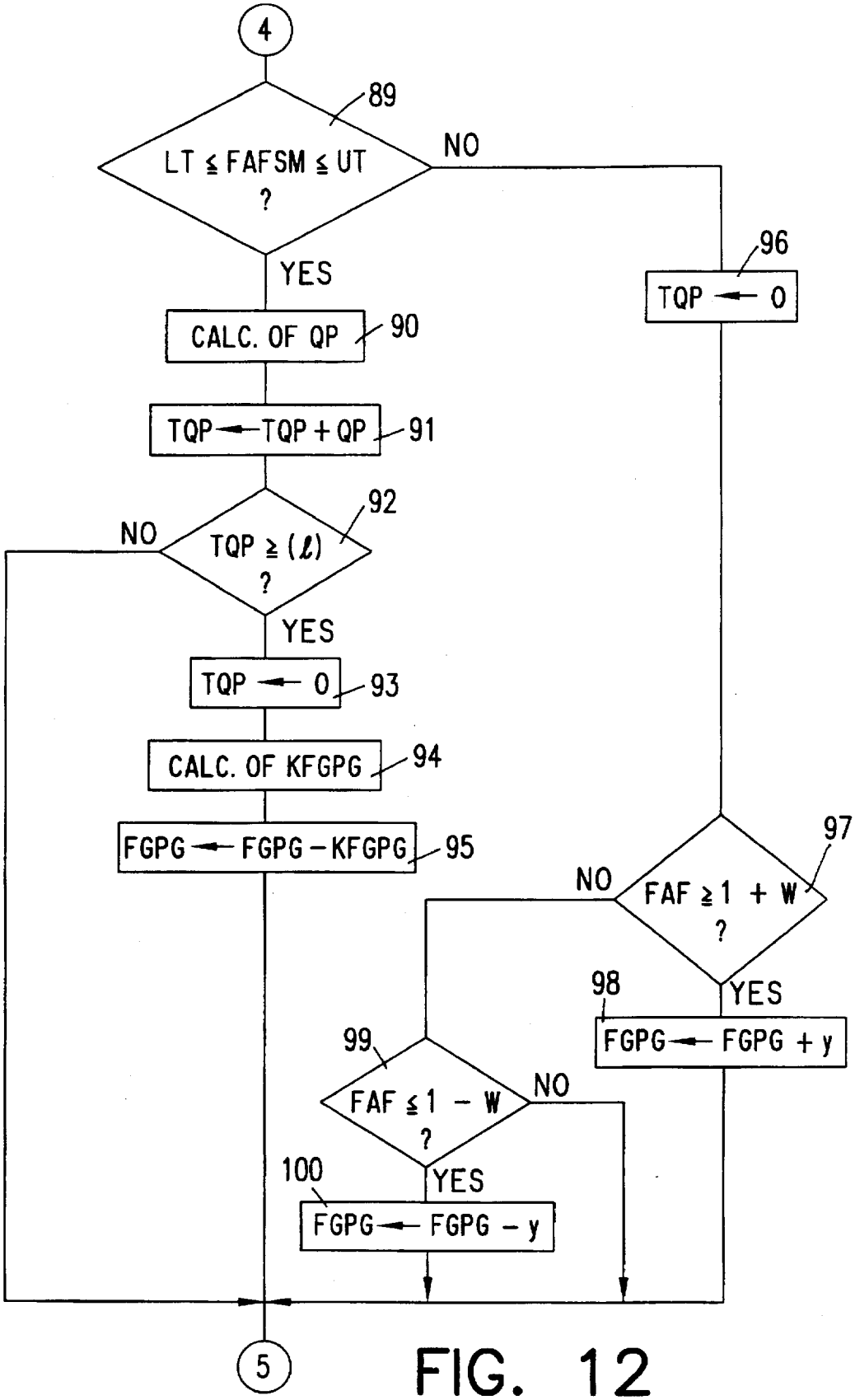

When F=2, the routine goes from step 70 in FIG. 10 to step 89 in FIG. 12, via step 74 in FIG. 10. Steps 90 to 95 are for renewing the fuel vapor concentration coefficient FGPG using the map shown in FIG. 5, and steps 97 to 100 are for renewing FGPG in accordance with the deviation of the feedback correction coefficient FAF. In step 89, it is determined whether the weighted mean of the feedback correction coefficient FAFSM is within the predetermined range, namely whether the weighted mean FAFSM is equal to or larger than the lower threshold LT and is equal to or smaller than the upper threshold UT. If LT≦FAFSM≦UT, it is determined that the renewing operation using the map of FIG. 5 has been properly carried out, and then the routine goes to step 90. In step 90, the amount of purge gas QP, purged from when the routine went to step 90 in the previous cycle to this time, is calculated in accordance with, for example, the opening TA of the throttle valve 7, the engine N, and the opening ratio of the purge control valve 17, namely the duty ratio therefor. Namely, the routine goes to step 90 every 100 ms and therefore the amount of the purge gas QP purged for 100 ms is calculated in step 90. In following step 91, the integrated amount of the purge gas TQP is calculated by adding the amount of the purge gas QP obtained in step 90 thereto. Then, the routine goes to step 92, where it is determined whether the integrated amount TQP is equal to or larger than a predetermined amount, such as 1 litter. If TQP<1 liter, the routine jumps to step 101 in FIG. 13. Contrarily, if TPQ≧1 liter, the routine goes to step 93, where the integrated amount TQP is made zero, and then the routine goes to step 94. Accordingly, the routine goes to step 94 whenever the integrated amount TQP reaches 1 liter. In step 94, the decrement KFGPG of the fuel vapor concentration coefficient FGPG is calculated using the map of FIG. 5. In following step 95, the fuel vapor concentration coefficient FGPG is renewed using a following equation:

$$FGPG=FGPG-KFGPG$$

Namely, FGPG is renewed by subtracting KFGPG from the current FGPG. Then, the routine goes to step 101 in FIG. 13.

Contrarily, if LT>FAFSM or FAFSM>UT, in step 89, the routine goes to step 96, where the integral amount TQP is cleared, and then the routine goes to step 97. Namely, if it is determined that the proper renewing of FGPG using the map in FIG. 5 is not carried out, the routine goes to step 97, where it is determined whether the feedback correction coefficient FAF is equal to or larger than an upper threshold 1+W. If FAF≧1+W, the routine goes to step 98, where a constant y is added to the current fuel vapor concentration coefficient FGPG. Then, the routine goes to step 101 in FIG. 13. Contrarily, if FAF<1+W, in step 97, the routine goes to step 99, where it is determined whether the feedback correction coefficient FAF is equal to or smaller than a lower threshold 1−W. If FAF≦1−W, the routine goes to step 100, where the constant y is subtracted from the current fuel vapor concentration coefficient FGPG. Then, the routine goes to step 101 of FIG. 13. If, FAF>1−W, in step 99, namely, if 1−W<FAF<1+W, the routine goes to step 101 in FIG. 13. Accordingly, the fuel vapor concentration coefficient FGPG remains unchanged if 1−W<FAF<1+W.

Figure 13:
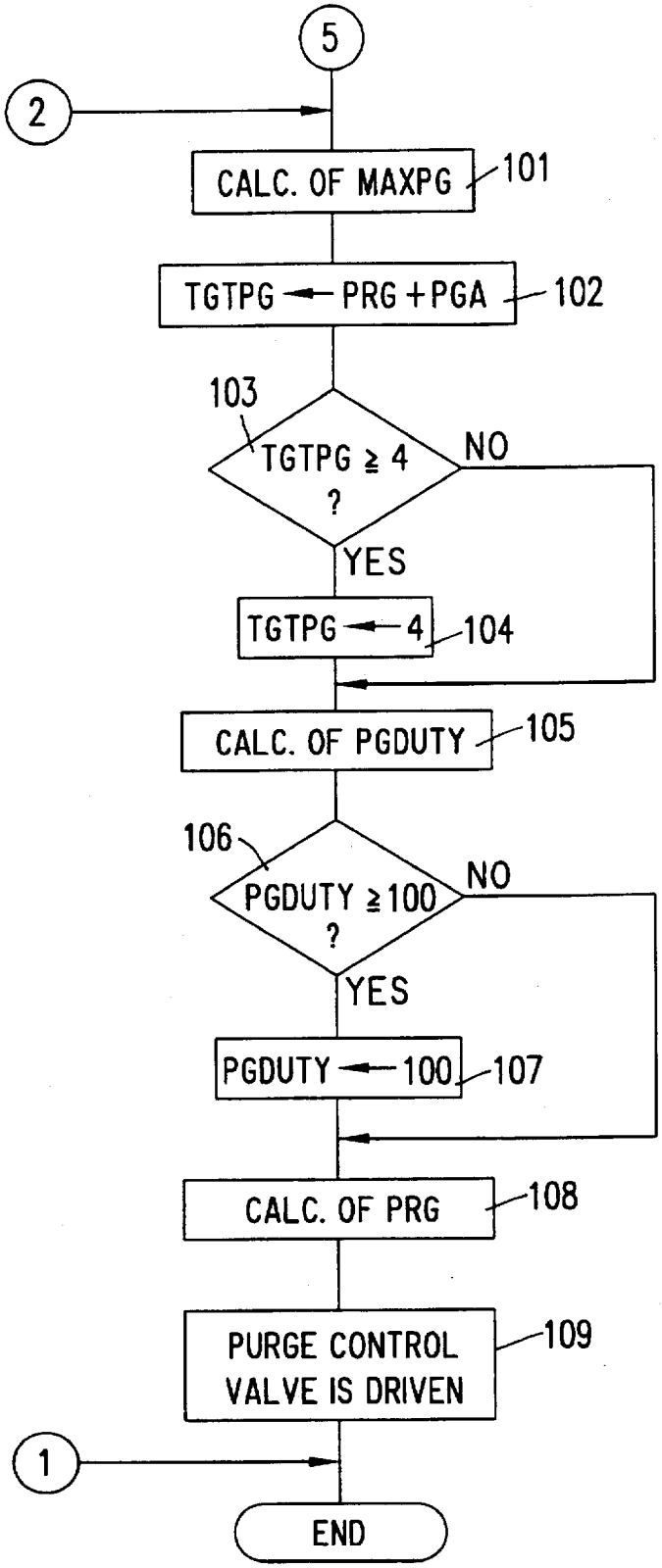

Steps 101 to step 109 shown in FIG. 13 are for determining the opening ratio of the purge control valve 17 and for driving the valve 17. In step 101, the maximum purge ratio MAXPG is calculated using the map shown in FIG. 4C, in accordance with the engine speed N and the engine load Q/N. In following step 102, the target purge ratio TGTPG is calculated by adding a predetermined constant increment PGA to the purge ratio PRG. Namely, the target purge ratio TGTPG is increased by PGA every 100 ms. In following step 103, it is determined whether the target purge ratio TGTPG is equal to or larger than 4%. If TGTPG<4%, the routine jumps to step 105. If TGTPG≧4%, the routine goes to step 104, where the target purge ratio TGTPG is made 4%. Then, the routine goes to step 105. If the purge ratio becomes too larg and thereby the amount of the purge gas becomes too large, it becomes difficult to maintain the air-fuel ratio at the stoichiometric air-fuel ratio. Therefore, the target purge ratio TGTPG is prevented from increasing over 4%.

In step 105, the duty ratio PGDUTY for the purge control valve 17 is calculated using a following equation:

$$PGDUTY=(TGTPG/MAXPG)\cdot 100$$

In following step 106, it is determined whether the duty ratio PGDUTY is equal to or larger than 100%. If PGDUTY<100%, the routine jumps to step 108. If PGDUTY≧100%, the routine goes to step 107, where the duty ratio PGDUTY is made 100%, and then the routine goes to step 108. In step 108, the purge ratio PRG is calculated using a following equation:

$$PRG=(MAXPG\cdot PGDUTY)/100$$

If the maximum purge ratio MAXPG becomes smaller and thereby (TGTPG/MAXPG)·100 becomes over 100, in step 105 in which the duty ratio PGDUTY is calculated, the duty ratio PGDUTY is fixed to 100. In this case, the purge ratio PRG is smaller than the target purge ratio TGTPG. Namely, if the maximum purge ratio MAXPG becomes smaller while the purge control valve 17 is almost fully opened, the purge ratio PRG is decreased. Note that the purge ratio PRG is equal to the target purge ratio TGTPG, as long as (TGTPG/MAXPG)·100 is no greater than 100. In following step 109, the purge control valve is driven in accordance with the duty ratio PGDUTY obtained in step 105 or 107. Then, the processing cycle is ended. Accordingly, when the purging operation starts, the target purge ration TGTPG increases gradually, and thereby the duty ratio PGDUTY increases gradually. Therefore, the amount of the purge gas purged into the engine increases gradually.

Figure 14:
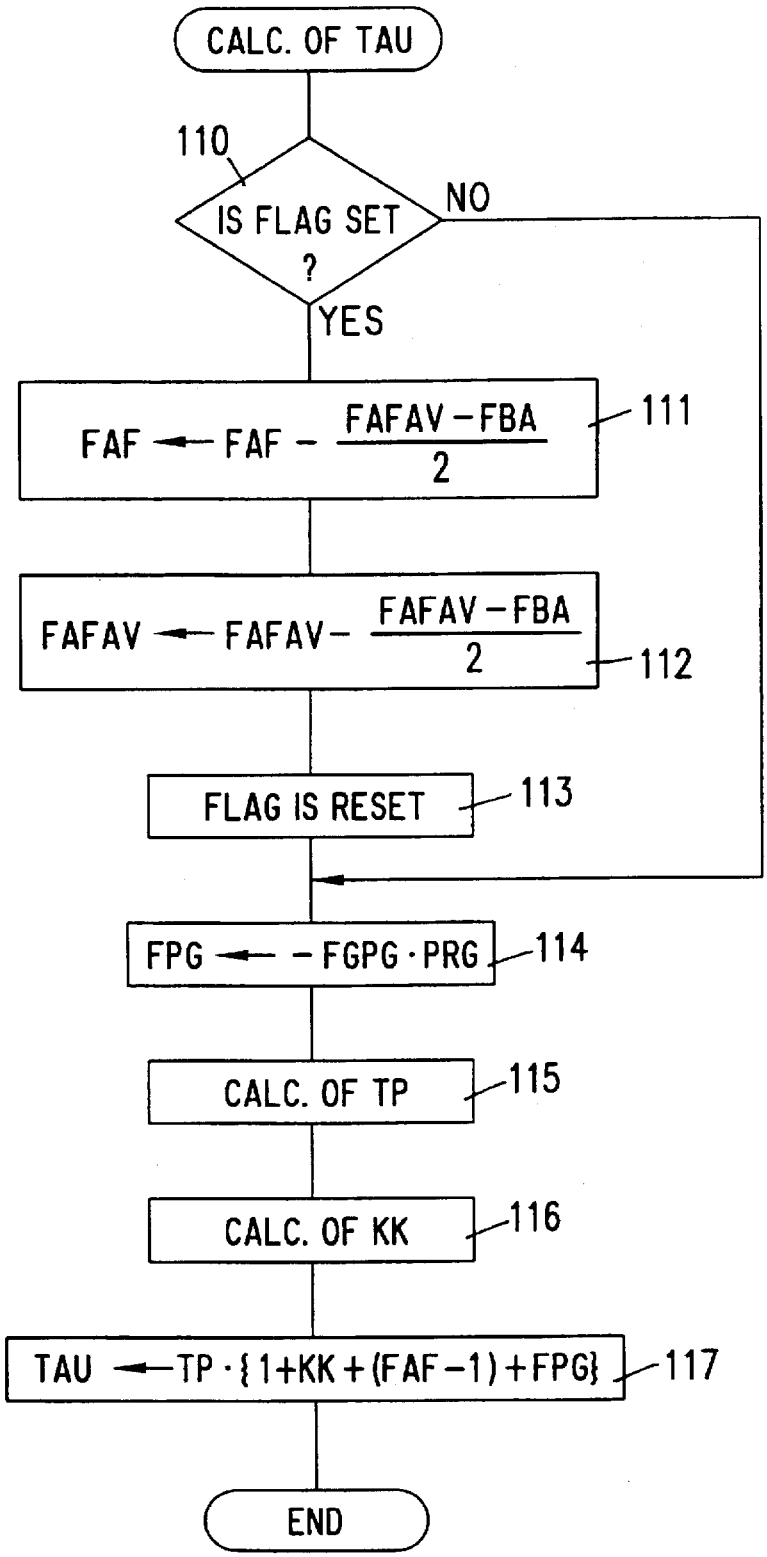
FIG. 14 is a flowchart for calculating a fuel injection time.

FIG. 14 is a routine for calculating the fuel injection time TAU. The routine is executed by interruption every predetermined crank angle.

Referring to FIG. 14, first, in step 110, it is determined whether the flag is set. If the flag is not set, the routine jumps to step 114. If the step is set, the routine goes to step 111, where the feedback correction coefficient FAF is decreased by the half of the difference between the current average of the feedback correction coefficient FAFAV and the beginning average of the feedback correction coefficient FBA. The flag is set every 15 sec, and thus this process is carried out every 15 sec. If FAFAV become smaller than FBA, the feedback correction coefficient FAF is increased by the half of the decrement of FAF. Namely, FAF is increased by the half of the decrement of FAF every 15 sec. In this condition, the fuel vapor concentration coefficient FGPG is increased by a value corresponding to the increment of FAF.

In following step 112, (FAFAV−FBA)/2 is subtracted from the average of the feedback correction coefficient FAFAV to change FAFAV by a value corresponding to the change of FAF. In following step 113, the flag is reset. Then, the routine goes to step 114.

In step 114, the purge correction coefficient FPG is calculated using a following equation:

$$FPG=(FGPG\cdot PRG)$$

In following steps 115 and 116, the basic fuel injection time TP and the enrichment KK are calculated, respectively. In following step 117, the fuel injection time TAU is calculated using a following equation:

$$TAU=TP\cdot\{1+KK+(FAF-1)+FPG\}$$

The fuel injection 4 injects fuel for this injection time TAU.

According to the present invention, it is possible to prevent an air-fuel ratio from fluctuating to thereby maintain the air-fuel ratio at a target air-fuel ratio.

While the invention has been described by reference to specific embodiments chosen for purposes of illustration, is should be apparent that numerous modifications could be made thereto by those skilled in the art without departing from the basic concept and scope of the invention.

We claim:

1. A fuel supply control system for an engine having an intake passage, a throttle valve arranged in the intake passage, and an exhaust passage, the system comprising:

a fuel injector for feeding fuel into the engine;

fuel amount calculating means for calculating an amount of fuel to be injected by the fuel injector;

an air-fuel ratio sensor arranged in the exhaust passage for sensing an air-fuel ratio of the engine;

a first correcting means for correcting the amount of fuel by a feedback correction coefficient in accordance with output signals of the air-fuel ratio sensor to make the air-fuel ratio equal to a target air-fuel ratio, the feedback correction coefficient having a reference value;

a canister for temporarily storing fuel vapor therein, the canister being connected to the intake passage downstream of the throttle valve via a purge passage;

purge means for purging a purge gas containing fuel vapor from the canister, via the purged passage, into the intake passage;

initial value calculating means for calculating an initial value of a fuel vapor concentration coefficient, which represents a concentration of fuel vapor in air fed into the engine, in accordance with a deviation of the feedback correction coefficient from the reference value, which deviation is caused when the purging operation starts;

decrement calculating means for periodically calculating a decrement of the fuel vapor concentration coefficient caused when the purging operation is carried out, the decrement being determined in accordance with the fuel vapor concentration coefficient;

first concentration coefficient calculating means for calculating the fuel vapor concentration coefficient by periodically reducing the fuel vapor calculated by initial value calculating means, by the decrement calculated by the decrement calculating means;

second correcting means for reducing the amount of fuel in accordance with the fuel vapor concentration coefficient, when the purge gas is purged into the intake passage; and control means for controlling second correcting means to carry out the correcting operation of second correcting means when the feedback correction coefficient is within a predetermined range, and to stop the correcting operation of second correcting means when the feedback correction coefficient is out of the predetermined range.

2. A system according to claim 1, wherein the predetermined range includes the reference value of the feedback correction coefficient.

3. A system according to claim 1, wherein the decrement calculating means calculates the decrement of the fuel vapor concentration coefficient and the first concentration coefficient calculating means calculates the fuel vapor concentration coefficient whenever the purge gas is purged by a predetermined amount.

4. A system according to claim 3, wherein the decrement calculating means calculates the decrement of the fuel vapor concentration coefficient based on a relationship between the fuel vapor concentration coefficient and the decrement thereof, the relationship being memorized in the system in advance.

5. A system according to claim 1, further comprising second concentration coefficient calculating means for calculating the fuel vapor concentration coefficient in accordance with the deviation of the feedback correction coefficient from the reference value, when the correcting operation of the first correcting means is stopped.

6. A system according to claim 1, further comprising purge gas amount control means for controlling an amount of the purge gas to make a purge ratio, which is determined as a ratio of the amount of the purge gas to that of air fed into the engine, equal to a target purge ratio.

7. A system according to claim 6, wherein the target purge ratio is gradually increased after the purging operation starts.

8. A system according to claim 7, wherein, when the target purge ratio reaches a predetermined upper limit, the target purge ratio is kept at the upper limit.

9. A system according to claim 6, the purge gas amount control means comprising a purge gas control valve arranged in the purge passage and valve control means for controlling the purge control valve, wherein the valve control means controls the purge control valve so that an opening ratio of the purge control valve is made equal to a ratio of the target purge ratio to a reference purge ratio, the reference purge ratio being determined in accordance with an engine operating state for the same opening ratio of the purge control valve.

10. A system according to claim 9, wherein the reference purge ratio is the purge ratio when the purge control valve is made substantially fully opened.

11. A system according to claim 6, wherein the fuel vapor concentration coefficient represents a concentration of fuel vapor in air fed into the engine per unit purge ratio, and wherein the second correcting means corrects the amount of fuel on the basis of the product of the purge ratio and the fuel vapor concentration coefficient.

12. A system according to claim 1, further comprising deviation reducing means for periodically closing the feedback correction coefficient toward the reference value thereof to thereby reduce the deviation of the feedback correction coefficient after the purging operation starts, the increasing means for periodically increasing the fuel vapor concentration coefficient by a value corresponding to a change of the feedback correction coefficient caused by the deviation reducing means.

13. A system according to claim 12, wherein the initial value calculating means determines the fuel vapor concentration coefficient when the feedback correction coefficient is substantially made the reference value, by the deviation reducing means as the initial value of the fuel vapor concentration coefficient.

14. A system according to claim 1, wherein the canister comprises: an activated charcoal layer housed therein; a fuel vapor chamber formed on one side of the activated charcoal layer; and an air chamber formed on another side of the activated charcoal layer, and wherein the fuel vapor chamber is connected to the intake passage downstream of the throttle valve via the purge passage and to a fuel vapor source, and the air chamber is connected to the outside air, whereby air passes through, in turn, the air chamber, the activated charcoal layer, the fuel layer chamber, and the intake passage to thereby form the purge gas, during the purging operation.

15. A system according to claim 14, the engine further having a fuel tank, wherein the fuel vapor source comprises the fuel tank.

16. A system according to claim 1, wherein the target air-fuel ratio is a stoichiometric air-fuel ratio.

* * * * *

UNITED STATES PATENT AND TRADEMARK OFFICE

CERTIFICATE OF CORRECTION

PATENT NO. : 5,727,537

DATED : March 17, 1998

INVENTOR(S) : Norihisa NAKAGAWA, et al.

It is certified that error appears in the above-identified patent and that said Letters Patent is hereby corrected as shown below:

Column 1, line 15, change "include" to --includes--.

Column 1, line 33, before "fuel vapor" insert --periodically calculated by subtracting the purged amount of--.

Column 1, line 50, change "reminder" to --remainder--.

Column 1, line 54, change "an" to --a--.

Column 3, line 14, change "designate" to --designates--.

Column 3, line 33, change "During" to --As--.

Column 3, line 54, change "A" to --An--.

Column 3, line 62, change "pulses" to --pulse--.

Column 6, line 40, change "preventing" to --prevented--.

Column 6, line 48, change "effected" to --affected--.

Column 7, line 9, before "maintains" insert --the embodiment--.

Column 7, line 22, change "amount" to --concentration--.

UNITED STATES PATENT AND TRADEMARK OFFICE

CERTIFICATE OF CORRECTION

PATENT NO. : 5,727,537

DATED : March 17, 1998

INVENTOR(S) : Norihisa NAKAGAWA, et al.

It is certified that error appears in the above-identified patent and that said Letters Patent is hereby corrected as shown below:

Column 7, line 42, change "become" to --becomes--.

Column 10, line 36, change "Therefor," to --Therefore,--.

Column 11, line 3, change "a" to --an--.

Column 12, line 57, change "pre" to --per--.

Column 12, line 62, change "101." at end of line to --13.--.

Column 13, line 22, change "litter" at beginning of line to --liter--.

Column 13, line 23, change "TPQ≥1" to --TQP≥1--.

Column 14, line 3, change "larg" to --large--.

Column 14, line 43, change "step is set," to --flag is set,--.

Column 15, line 8, change "is" to --it--.

UNITED STATES PATENT AND TRADEMARK OFFICE

CERTIFICATE OF CORRECTION

PATENT NO. : 5,727,537

DATED : March 17, 1998

INVENTOR(S) : Norihisa NAKAGAWA, et al.

It is certified that error appears in the above-identified patent and that said Letters Patent is hereby corrected as shown below:

Column 15, line 48, after "vapor" insert--concentration coefficient, from the initial value--.

Column 17, line 5, change "layer chamber," to --vapor chamber--.

Signed and Sealed this

Twenty-ninth Day of December, 1998

*Attest:*

*Attesting Officer*

BRUCE LEHMAN

*Commissioner of Patents and Trademarks*